United States Patent [19]

Foster

[11] Patent Number: 4,947,506

[45] Date of Patent: Aug. 14, 1990

[54] PORTABLE APPLIANCE COVER

[75] Inventor: David W. Foster, Germantown, Md.

[73] Assignee: Soft Vac, Inc., Washington, D.C.

[21] Appl. No.: 407,453

[22] Filed: Sep. 14, 1989

Related U.S. Application Data

[63] Continuation of Ser. No. 223,093, Jul. 22, 1988, Pat. No. 4,876,762.

[51] Int. Cl.[5] ..... A47L 9/00

[52] U.S. Cl. ..... 15/247; 15/257 A; 15/325

[58] Field of Search ..... 15/45, 246, 257 A, 325, 15/326, 339

[56] References Cited

U.S. PATENT DOCUMENTS

| | | | |
|---|---|---|---|
| 982,640 | 1/1911 | Spencer | 15/325 X |
| 1,570,482 | 1/1926 | Hale | 15/45 |
| 2,241,862 | 5/1941 | Longille | 15/325 |
| 3,516,110 | 5/1970 | Nilsson | 15/325 |
| 3,884,922 | 5/1975 | Fleischhauer | 15/327 R |
| 4,437,204 | 3/1984 | Guhne | 15/325 |
| 4,797,968 | 1/1989 | Wenzlick et al. | 15/325 |
| 4,831,682 | 5/1989 | White | 15/325 |

FOREIGN PATENT DOCUMENTS

| | | | |
|---|---|---|---|
| 6208/27 | 3/1927 | Australia | 15/326 |
| 1951214 | 5/1970 | German Democratic Rep. A | 15/257 |
| 2154128 | 9/1985 | United Kingdom | 15/325 |

*Primary Examiner*—Chris K. Moore

*Attorney, Agent, or Firm*—Finnegan, Henderson, Farabow, Garrett & Dunner

[57] ABSTRACT

A cover for a portable appliance that includes a body section having a bottom surface disposed adjacent a floor when the appliance is in use, a top surface opposite the bottom section and a side surface between and connecting the top and bottom sections. The cover includes a removable bonnet for substantially covering the top surface and side surface of the body section and being capable of absorbing mechanical energy. The cover further includes a retaining device for removably retaining the removable bonnet to the body section of the appliance. The retaining device is capable of holding the bonnet at a fixed spaced relationship to the bottom of the body section of the appliance to establish a predetermined spacing between the cover and the floor when the appliance is disposed on the floor.

6 Claims, 2 Drawing Sheets

PORTABLE APPLIANCE COVER

This is a continuation of application Ser. No. 07/223,093, filed Jul. 22, 1988, now U.S. Pat. No. 4,876,762, issued Oct. 31, 1989.

BACKGROUND OF THE INVENTION

1. Field of the Invention

The present invention relates to cleaning appliance covers and, more particularly, to covers for vacuum cleaners.

2. Description of Related Art

In the art of home or office cleaning, a long-standing problem is that of damage caused to fixtures, walls or movables by portable cleaning appliances during cleaning and the concomitant damage to the portable cleaning appliances themselves. This damage is caused by a cleaning worker inadvertently bringing a cleaning appliance into contact with fixtures, walls or movables in an area being cleaned. While the present invention has utility in the prevention of damage to all fixtures and movables it will, for the sake of simplicity, be described in reference to the prevention of damage caused to furniture and walls. Further, while the present invention has utility in the prevention of damage caused by and to all portable cleaning appliances, it will, for the sake of simplicity, be described specifically in reference to vacuum cleaners As a rule, the contact of a vacuum cleaner with furniture during cleaning is sufficiently light that no appreciable damage is caused to the furniture. On occasion, however, contact with a vacuum cleaner and furniture is so great that damage is caused to the furniture, the vacuum cleaner, or both. The damage can be very expensive. When cleaning operations are done on a commercial basis the cost to the commercial enterprise can be significant.

To date, attempts to solve this problem have been lacking in several respects. One possible solution is to hire and train personnel to clean in such a fashion that they do not cause damage to furniture. This has not proven possible. A second possible solution is to provide some form of a cushion on vacuum cleaners so that when the inevitable collision between vacuum cleaner and furniture occurs, neither the furniture nor the vacuum cleaner are harmed. An attempt to realize this second solution is disclosed in U.S. Pat. No. 2,241,862. The '862 patent discloses molded rubber covers affixed to vacuum cleaners. These covers, however, may leave marks upon contact with a surface that are difficult and expensive to clean off. Further, covers in accordance with the '862 patent do not cover the entirety of the vacuum cleaner body, leaving areas exposed that may cause damage, or that may be damaged themselves.

Another attempt to realize the second solution to the problem was to attach resilient material, such as carpet, to the body of a vacuum cleaner, by, for example, gluing. This approach presents several problems, however. First, maintenance costs rise because it is first necessary to remove the carpet prior to attempting to disassemble a vacuum cleaner for repairs. Second, it is unsightly. Third, it is ineffective for preventing many types of damage to vacuum cleaners and furniture because it leaves exposed areas.

Because vacuum cleaners in commercial operation operate on a continuous basis, any type of cover or protective device must allow for adequate cooling and access to controls on the vacuum cleaner. Further, a cover is subject to damage itself and must be sufficiently strong to withstand abuse. Further still, it should, particularly in commercial operations, present a good appearance and be capable of being cleaned.

SUMMARY OF THE INVENTION

The present invention overcomes the problems and disadvantages of the prior art by providing a cover for a portable appliance, such as, for example, a vacuum cleaner, that is capable of absorbing mechanical energy when, for example, the vacuum cleaner comes into contact with a piece of furniture during cleaning. Further, it does not restrict the flow of air to the appliance for cooling, is easily removed, yet remains attached during use. Further still, a cover in accordance with the present invention is attractive and easily laundered so as to retain its proper and professional appearance.

Additional objects and advantages of the invention will be set forth in part in the description which follows, and in part will be obvious from the description, or may be learned by practice of the invention. The objects and advantages of the invention may be realized and attained by means and the instrumentalities and combinations particularly pointed out in the appended claims.

To achieve the objects and in accordance with the purpose of the invention, as embodied and broadly described herein, cover for a portable appliance is provided, where the appliance includes a body section having a bottom surface disposed adjacent a floor when the appliance is in use, a top surface opposite the bottom section and a side surface between and connecting the top and bottom sections. The cover of this invention comprises removable bonnet means for substantially covering one or more of the top surface and side surface of the body section and being capable of absorbing mechanical energy; and retaining means for removably attaching said removable bonnet means to the body section of the appliance said retaining means being capable of holding said bonnet means at a fixed spaced relationship to the bottom of the body section of the appliance to establish a predetermined spacing between the cover and the floor when the appliance is disposed on the floor.

The accompanying drawings, which are incorporated in and constitute a part of this specification, illustrate one embodiment of the invention and, together with the description, serve to explain the principle of the invention.

DESCRIPTION OF THE PREFERRED EMBODIMENT

Reference will now be made in detail to the present preferred embodiment of the invention, an example of which is illustrated in the accompanying drawings.

Figure 1:
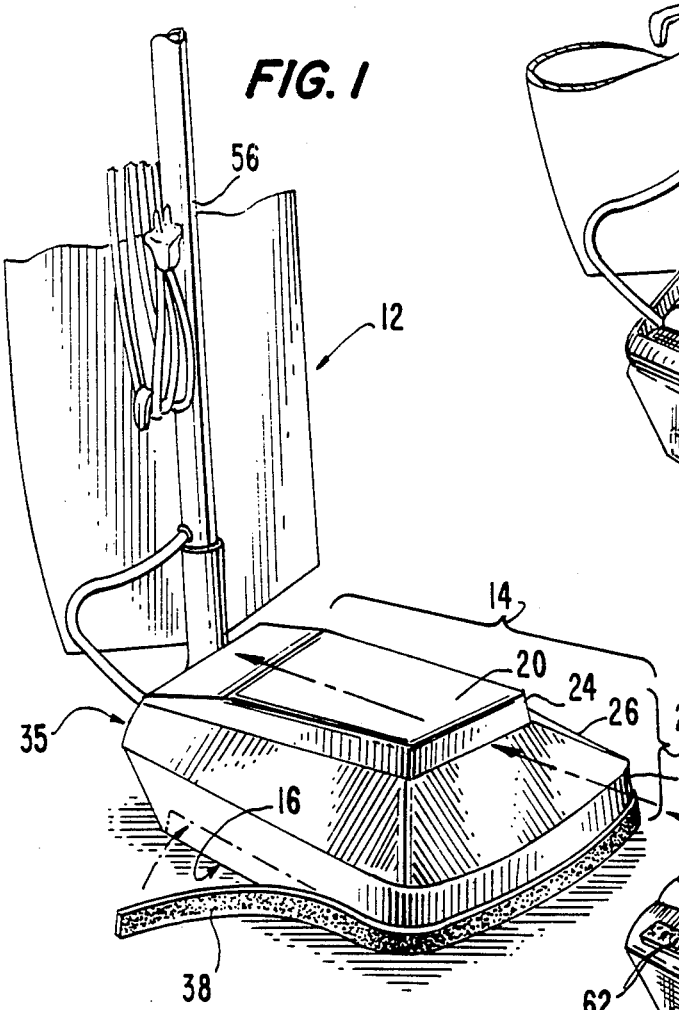
FIG. 1 is an exploded perspective view of an appliance cover in accordance with the present invention shown in relation to an appliance.

The preferred embodiment of an appliance cover in accordance with the present invention is shown in FIG. 1 and represented generally by the numeral 10. Also shown in FIG. 1, and represented generally by the numeral 12, is a vacuum cleaner.

It should be understood that the present invention pertains to portable cleaning appliances other than vacuum cleaners such as, for example, floor polishers, floor waxers, extraction machines, floor sanders and rug shampooers. Further, the principles of the present invention may find application to non-powered cleaning appliances such as barrels, buckets, trash carts and the like. The present invention should not be limited, therefore, to vacuum cleaners.

Vacuum cleaner 12 includes a body section 14. Body section 14 includes a body surface 16 disposed adjacent a floor 18 when vacuum cleaner 12 is in use. Vacuum cleaner 12 further includes a top surface 20 opposite the bottom surface 16 and a side surface 22 between and connecting bottom surface 16 and top surface 20.

As can be appreciated from FIG. 1, vacuum cleaner 12 may have a body section 14 that has a variety of shapes and sizes. For example, side section 22 may include any number of intermediate side sections, such as, for example, first, second and third intermediate side sections 24, 26 and 28, respectively, shown in FIG. 1. First, second and third intermediate side sections 24, 26 and 28, respectively, may have any desired shape, size and degree of inclination. Similarly, top section 20 may have any desired shape, size and degree of inclination. Further, there is no requirement that top section 20 be planar as shown in FIG. 1.

In accordance with the present invention, removable bonnet means are provided for substantially covering one or more of the top surface and side surface of the body section of the portable appliance and being capable of absorbing mechanical energy. As embodied herein, and shown in FIGS. 1–5, removable bonnet means include a bonnet 30. Bonnet 30, as shown in FIG. 1, is so constructed that it is slidable into intimate physical contact with body section 14 of vacuum cleaner 12.

Figure 2:
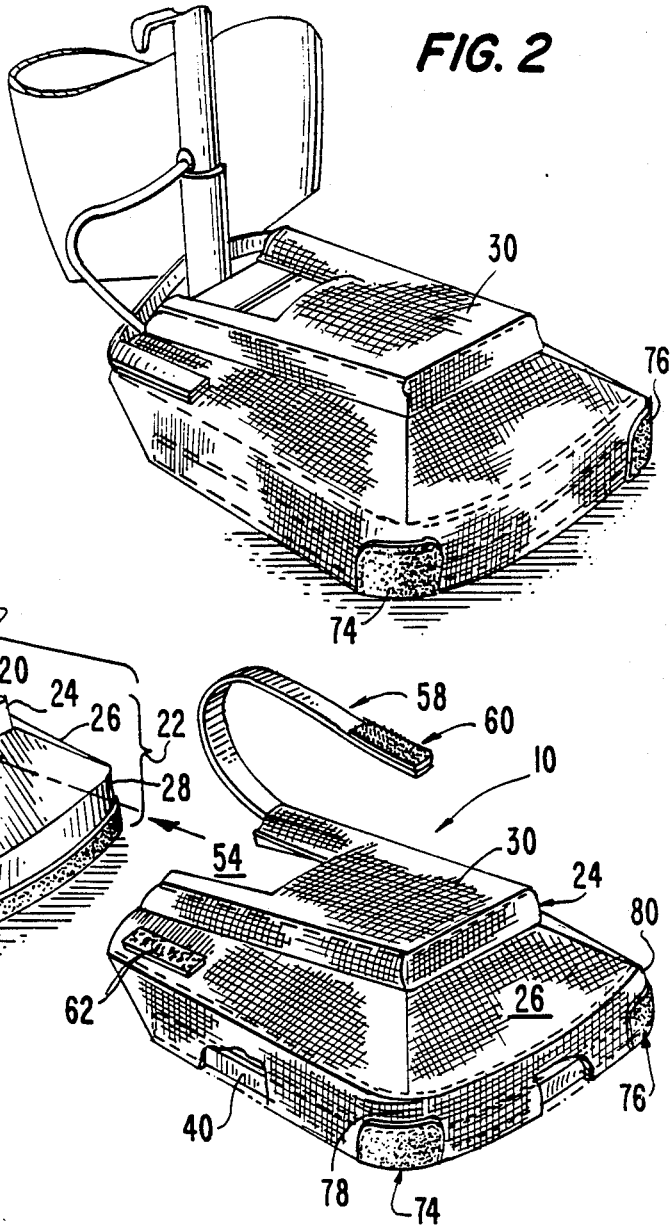
FIG. 2 is a perspective view of the appliance cover of FIG. 1 shown in removable engagement with an appliance.
Figure 3:
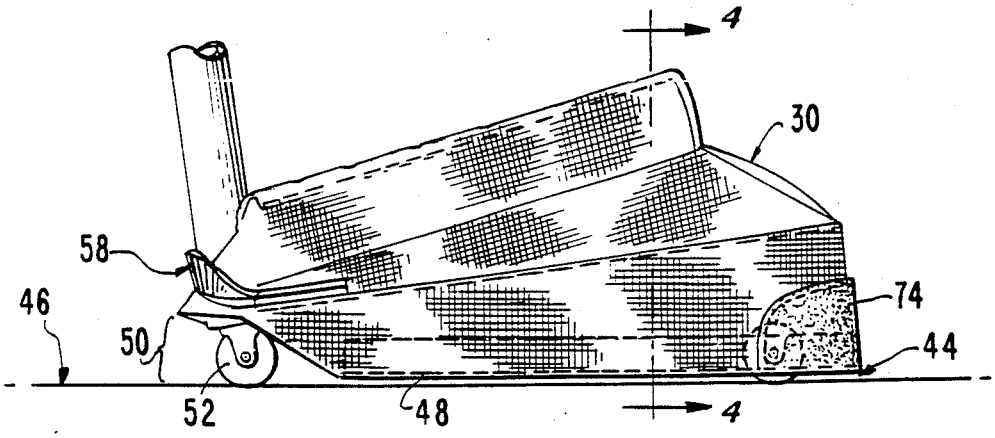
FIG. 3 is a side view of the appliance cover of FIG. 1 shown in removable engagement with an appliance.

Bonnet 30 includes an inner lining 32, an outer lining 34 for intimately and physically engaging the top surface and side surface of the appliance, and energy absorbing means 36, disposed between said inner and outer linings for absorbing mechanical energy. As shown in FIGS. 1–3, bonnet 30 does not physically engage back surface 35 of body section 14. Because back surface 35 does not normally contact furniture it is not deemed necessary to extend bonnet 30 to cover it. If so desired, however, bonnet 30 may be extended to cover back surface 35.

As embodied herein, inner lining 32 and outer lining 34 are made of marine grade canvas. Marine grade canvas is chosen because of its good wearability, resistance to mildew and the facts that it can be easily laundered. One such type of marine grade canvas is, for example, Boltex No. 1038, manufactured by Astrup of Cincinnati, Ohio.

Energy absorbing means 36 is embodied herein as a single or multiple layer of foam. Also as embodied herein, inner liner 32 includes a first portion **32*a* in intimate physical contact with top section 20, a second portion 32*b* in intimate physical contact with first intermediate side section 24, a third portion 32*c* in intimate physical contact with second intermediate side section 26 and a fourth portion 32*d* in intimate physical contact with third intermediate size section 28. Similarly, outer lining 34 includes first, second, third and fourth positions, 34*a*, 34*b*, 34*c* and 34*d*, respectively, and energy absorbing means 36 includes first, second, third and fourth portions 36*a*, 36*b*, 36*c* and 36*d***, respectively.

Preferably, first, second, third and fourth portions, **36*a*, 36*b*, 36*c* and 36*d*, respectively, of energy absorbing means 36 are all sufficiently stiff to make bonnet 30 structurally sound so that bonnet 30 can stand on its own without collapsing, as shown in FIG. 1, before being placed in intimate contact with body section 14 of vacuum cleaner 12. This provides the bonnet 30 with a professional appearance characterized by an absence of wrinkles and avoidance of wrinkles and/or sagging through continued usage over a long period of time. The present inventor has found that second and fourth portions 36*b* and 36*d*, respectively, of energy absorbing means 36 can be of a high density foam such as 2# density Trocellen manufactured by Dynamit Noble of American, Inc. of South Holland, Ill. of ½ in. thickness and first and third portions 36*a* and 36*c*, respectively, of energy absorbing means 36** can be of polyfoam ½ in. thickness to accomplish the purposes of the present invention.

A cover in accordance with the present invention includes retaining means for removably attaching the removable bonnet means to the body section of the appliance. As embodied herein, the retaining means includes a first fastener 38 and a second fastener 40 that can be removably fastened to first fastener 38. First and second fasteners 38 and 40, respectively, can be, for example, the two sides (hook and loop) of a Velcro® brand fastener. First fastener 38 is bonded to third intermediate side section 28 by, for example, an adhesive strip 42. Second fastener is fixed to fourth position **32*d* of inner liner 32** by, for example, stitching or adhesive.

Retaining means, in accordance with the present invention, serves two functions. First, it prevents bonnet 30 from being forcibly separated from body section 14 of vacuum cleaner 12 if the assembly comes in contact with furniture. Second, as more fully explained below, retaining means in accordance with the present invention, establishes a gap between bonnet 30 and floor 46 to allow proper clearance over the floor for the vacuum cleaner 12 to move and to have sufficient air intake and flow for suction and cooling.

In accordance with the present invention, the retaining means is capable of holding the bonnet means at a fixed, spaced relationship to the bottom of the body section of the appliance to establish a pre-determined spacing between the cover and the floor when the appliance is disposed on the floor. As embodied herein, first and second fasteners 38 and 40, respectively are fixed to a third intermediate side section 28 of appliance 12 and fourth portion **32*d* of inner liner 32 so that when first and second fasteners 38 and 40, respectively are fastened together a clearance or gap 44 is established between the bonnet 30 and floor 46. Gap 44 is substantially uniform between a bottom edge 48 of bonnet 30 and floor 46 and is set to provide adequate clearance between bottom edge 48 and floor 46. The width of gap 44 can be adjusted by changing the position of first fastener 38 on third intermediate side section 28**.

Figure 4:
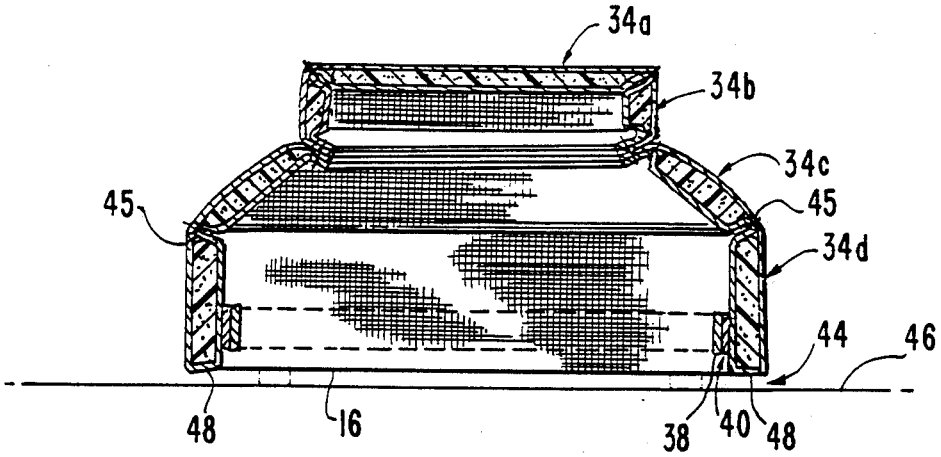
FIG. 4 is a sectional view of the appliance cover of FIG. 3 taken along sectional line 4—4 of FIG. 3.
Figure 5:
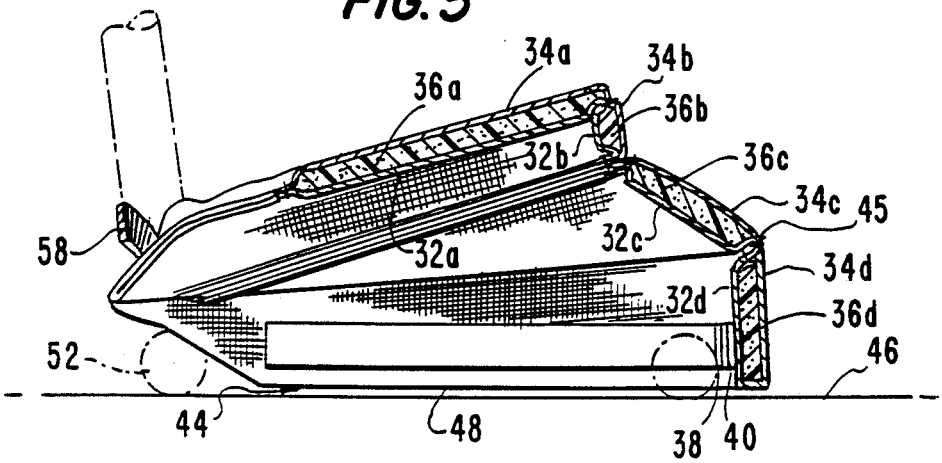
FIG. 5 is a side sectional view of an appliance cover in accordance with the present invention shown in removable engagement with an appliance.

Preferably, and as shown in FIGS. 4 and 5, a seam 45 is provided between third portions of inner and outer liners 32*c* and 34*c*, respectively, and fourth portions of inner and outer liners 32*d* and 34*d*, respectively. Seam 43 ensures that first and second fasteners, 38 and 40, respectively, are naturally held flush together without any residual stress that would tend to pull them apart.

Preferably, and as shown particularly in FIG. 3, bonnet 30 includes a notch 50 in the rear of fourth portions 32*d*, 34*d* and 36*d* to provide additional clearance adjacent rear wheels 52 between bonnet 30 and floor 46. Thus, body section 14 of vacuum cleaner 12, with bonnet 30 attached, may be rotated about rear wheels 52 without bonnet 30 interfering with floor 46.

Bonnet 30 also, preferably, includes a cut-out section 54. Cut-out section 54 provides clearance for an adjustable upright arm 56 of vacuum cleaner 12. Thus, adjustable upright arm 56 can be rotated from the upright position shown in FIG. 1 to any other desired position without being interferred with by bonnet 30. A strap 58 is further provided to removably engage bonnet 30 to upright arm 56. Strap 58 is fixed at one end to bonnet 30 and has a first fastener 60 at the other end that is removably fastenable to second fastener 62. First and second fasteners 60 and 62, respectively, can be, for example, Velcro ® fasteners. Strap 58 is adjustable and does not interfere with motion of handle 56.

Figure 6:
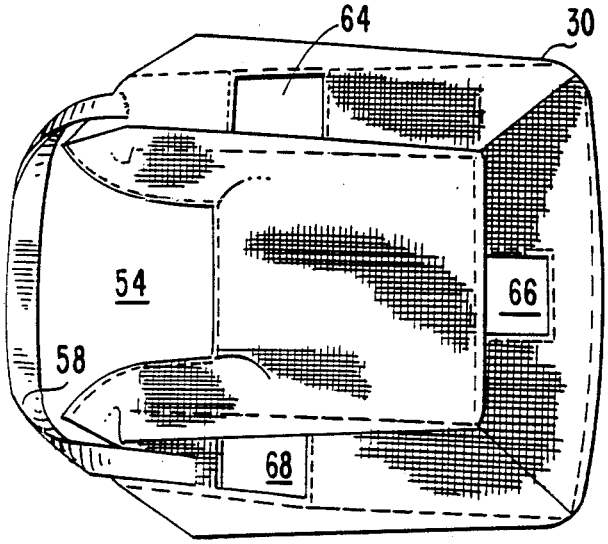
FIG. 6 is a top view of an appliance cover in accordance with the present invention.
Figure 7:
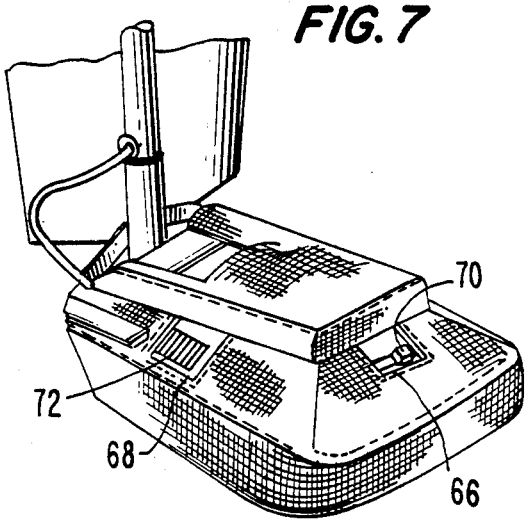
FIG. 7 is a perspective view of the appliance cover of FIG. 6 shown in removable engagement with an appliance.

A cover in accordance with the present invention may include one or more apertures therethrough to allow access to the sides and top of the portable appliance. As embodied herein, and shown in FIGS. 6 and 7, bonnet 30 may include first, second and third apertures 64, 66 and 68, respectively, that extend through inner liner 32, energy absorbing means 36 and outer liner 34. As shown in FIG. 7, second aperture 66 is provided to allow access to, for example, a level postion switch 70 to control the level of body section 14 over floor 46 and third aperture 68 is provided to allow access to a, for example, vent 72.

Bonnet 30 may, optionally, include abrasion protection means at points on outer lining 34 where abrasion damage is most likely to occur. Such abrasion protection means can be, for example, patches 74 and 76 affixed to the front corners 78 and 80, respectively, of fourth portion 34*d* of outer lining 34. Patches 74 and 76 may be, for example, patches of 6/7 oz. natural leather.

It will be apparent to those skilled in the art that various modifications and variations can be made in the portable appliance cover of the present invention without departing from the scope or spirit of the invention. Thus, it is intended that the present invention cover the modifications and variations of this invention provided they are within the scope of the appended claims and their equivalents.

What is claimed is:

1. A cover for a portable appliance, the appliance including a body section having a bottom surface disposed adjacent a floor when the appliance is in use, a top surface opposite the bottom surface and a side surface between and connecting the top and bottom surfaces, the cover comprising:

removable bonnet means for substantially covering one or more of the top surface and side surface of the body section and being capable of absorbing mechanical energy; and retaining means for removably attaching said removable bonnet means to the body section of the appliance, said retaining means being capable of holding said bonnet means at a fixed spaced relationship to the bottom surface of the body section of the appliance to establish a selected spacing between the cover and the floor when the appliance is disposed on the floor.

2. A cover as claimed in claim 1 wherein the cover further includes one or more apertures therethrough to allow access to the sides and top of said appliance.

3. The cover as claimed in claim 1, wherein the retaining means includes a first fastener fixed to the side surface of the body section and a second fastener fixed to the bonnet means, the second fastener being removably fastenable to the first fastener.

4. The cover as claimed in claim 3, wherein the retaining means is a hook and loop type fastening system with the first fastener being a hook type fastener and the second fastener being a loop type fastener.

5. A protective cover for a portable appliance, the appliance including a body section having a bottom surface disposed adjacent a floor when the appliance is in use, a top surface opposite the bottom surface and a side surface between and connecting the top and bottom surfaces, the cover comprising:

removable protective means for substantially covering the side surface of the body section and being capable of absorbing mechanical energy; and retaining means for removably attaching the protective means to the side surface of the body section, the retaining means being capable of holding the protective means at a fixed spaced relationship to the bottom of the body section of the appliance to establish a selected spacing between the protective means and the floor when the appliance is disposed on the floor, the retaining means including a first fastener fixed to the side surface of the body section and a second fastener fixed to the protective means, the second fastener being removably fastenable to the first fastener.

6. The cover as claimed in claim 5 wherein the retaining means is a hook and loop type fastening system with the first fastener being a hook type fastener and the second fastener being a loop type fastener.

* * * * *

UNITED STATES PATENT AND TRADEMARK OFFICE

CERTIFICATE OF CORRECTION

PATENT NO. : B1 4,947,506

DATED : September 6, 1994

INVENTOR(S) : David W. Foster

It is certified that error appears in the above-identified patent and that said Letters Patent is hereby corrected as shown below:

Claim 1,Column 1, line 23, after "for", insert --a--.

Column 2, line 19, delete "surface" and insert --surfaces--.

Signed and Sealed this

Fifteenth Day of November, 1994

*Attest:*

*Attesting Officer*

Bruce Lehman

BRUCE LEHMAN

*Commissioner of Patents and Trademarks*

US004947506B1

REEXAMINATION CERTIFICATE (2378th)

United States Patent [19]

Foster

[11] B1 4,947,506

[45] Certificate Issued Sep. 6, 1994

[54] PORTABLE APPLIANCE COVER

[75] Inventor: David W. Foster, Germantown, Md.

[73] Assignee: Soft Vac, Inc., Washington, D.C.

Reexamination Request:
No. 90/003,018, Mar. 30, 1993

Reexamination Certificate for:

| | |
|---|---|
| Patent No.: | **4,947,506** |
| Issued: | **Aug. 14, 1990** |
| Appl. No.: | **407,453** |
| Filed: | **Sep. 14, 1989** |

Related U.S. Application Data

[63] Continuation of Ser. No. 223,093, Jul. 22, 1988, Pat. No. 4,876,762.

[51] Int. Cl.[5] ..... A47L 9/00

[52] U.S. Cl. ..... 15/247; 15/246.2; 15/325

[58] Field of Search ..... 15/325, 246.2, 257.1, 15/45, 326, 339; 150/165

[56] References Cited

U.S. PATENT DOCUMENTS

| | | | |
|---|---|---|---|
| 982,640 | 1/1911 | Spencer | 15/325 X |
| 1,570,482 | 1/1926 | Hale | 15/45 |
| 1,978,579 | 10/1934 | Hooks | 15/403 |
| 2,241,862 | 5/1941 | Longille | 15/325 |
| 2,247,946 | 7/1941 | Hein | 15/257 |
| 3,516,110 | 6/1970 | Nilsson | 15/325 |
| 3,883,922 | 5/1975 | Fleischhauer | 15/327 |
| 3,977,451 | 8/1976 | Duba | 150/15 |
| 4,258,821 | 3/1981 | Wendt et al. | 181/202 |
| 4,437,204 | 3/1984 | Guhne | 15/325 |
| 4,638,523 | 1/1987 | Todd | 15/98 |
| 4,797,968 | 1/1989 | Wenzlick et al. | 15/246 |
| 4,831,682 | 5/1989 | White | 15/325 |

FOREIGN PATENT DOCUMENTS

| | | | |
|---|---|---|---|
| 6,208,127 | 3/1927 | Australia | 15/327 |
| 1,065,915 | 4/1967 | Great Britain . | |
| 1,951,214 | 5/1970 | Germ. D.R. | 15/257.01 |
| 2,154,128 | 9/1985 | Great Britain . | |

OTHER PUBLICATIONS

Pioneer Eclipse Laser-X Buffer Operating Manual. Copywrite 1985.

Pioneer Eclipse Laser-X Buffer Operating Manual. No Acceptable date.

*Primary Examiner*—Chris K. Moore

[57] ABSTRACT

A cover for a portable appliance that includes a body section having a bottom surface disposed adjacent a floor when the appliance is in use, a top surface opposite the bottom section and a side surface between and connecting the top and bottom sections. The cover includes a removable bonnet for substantially covering the top surface and side surface of the body section and being capable of absorbing mechanical energy. The cover further includes a retaining device for removably retaining the removable bonnet to the body section of the appliance. The retaining device is capable of holding the bonnet at a fixed spaced relationship to the bottom of the body section of the application to establish a predetermined spacing between the cover and the floor when the appliance is disposed on the floor.

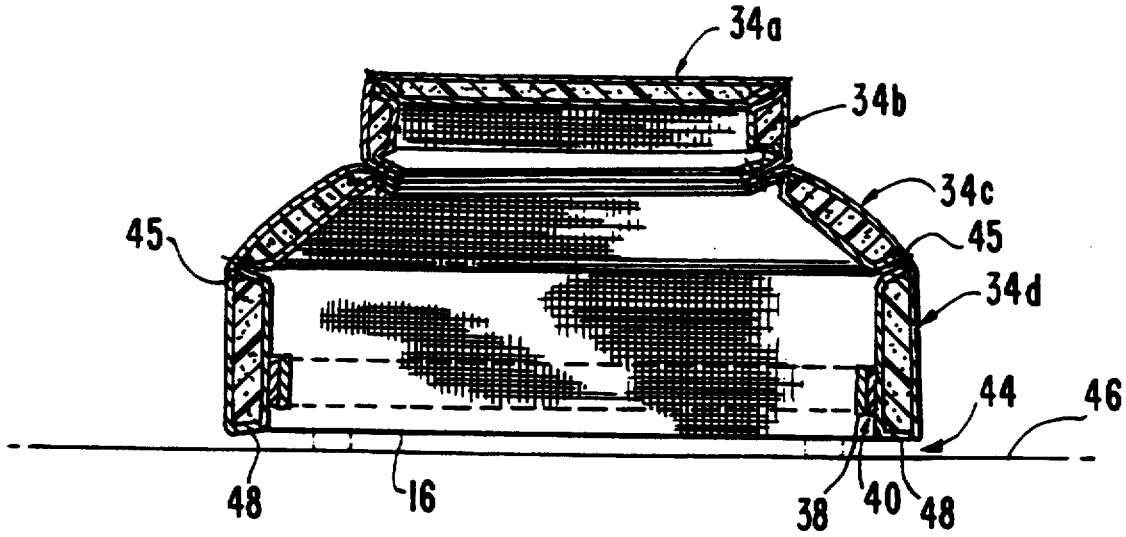

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 5 are determined to be patentable as amended.

Claims 2–4 and 6, dependent on an amended claim, are determined to be patentable.

1. A cover for portable appliance, the appliance including a body section having a bottom surface disposed adjacent a floor when the appliance is in use, a top surface opposite the bottom surface and a side surface between and connecting the top and bottom surfaces, the cover comprising:

removable bonnet means for substantially covering one or more of the top surface and side surface of the body section and being capable of absorbing mechanical energy, *the bonnet means including a portion that traverses the top surface of the body section and is capable of absorbing mechanical energy*; and retaining means for removably attaching said removable bonnet means to the body section of the appliance, said retaining means being capable of holding said bonnet means at a fixed spaced relationship to the bottom surface of the body section of the appliance to establish a selected spacing between the cover and the floor when the appliance is disposed on the floor.

5. A protective cover for a portable appliance, the appliance including a body section having a bottom surface disposed adjacent a floor when the appliance is in use, a top surface opposite the bottom surface and a side surface between and connecting the top and bottom surfaces, the cover comprising:

removable protective means for substantially covering the side surface of the body section and being capable of absorbing mechanical energy, *the protective means including at least a strip having inner and outer surface*; and retaining means for removably attaching the protective means to the side surface of the body section, the retaining means being capable of holding the protective means at a fixed spaced relationship to the bottom of the body section of the appliance to establish a selected spacing between the protective means and the floor when the appliance is disposed on the floor, the retaining means including a first fastener fixed to the side surface of the body section and a second fastener fixed to *the inner surface of* the protective means, the second fastener being removably fastenable to the first fastener *to attach the protective means to the body section of the appliance without impairing the energy absorbing ability of said protective means.*

* * * * *